US005201362A

United States Patent [19]

Yamagami et al.

[11] Patent Number: 5,201,362

[45] Date of Patent: Apr. 13, 1993

[54] CONTINUOUS CASTING METHOD OF THIN STRIP

[75] Inventors: Yasuhiro Yamagami, Futtsu; Hiroyuki Nakajima, Hikari; Kensuke Shimomura, Hikari; Hidetake Oka, Hikari, all of Japan

[73] Assignee: Nippon Steel Corporation, Tokyo, Japan

[21] Appl. No.: 805,542

[22] Filed: Dec. 10, 1991

[51] Int. Cl.[5] ..... B22D 11/06

[52] U.S. Cl. ..... 164/480; 164/483

[58] Field of Search ..... 164/480, 428, 483, 451, 164/452, 121

[56] References Cited

U.S. PATENT DOCUMENTS

| | | | |
|---|---|---|---|
| 4,811,780 | 3/1989 | Yamauchi | 164/428 |
| 5,035,278 | 8/1991 | Hasegawa | 164/428 |
| 5,058,657 | 10/1991 | Hasegawa | 164/428 |

FOREIGN PATENT DOCUMENTS

| | | | |
|---|---|---|---|
| 0362721 | 4/1990 | European Pat. Off. | 164/480 |
| 0221646 | 12/1983 | Japan | 164/452 |
| 0215254 | 12/1984 | Japan | 164/480 |
| 0176447 | 8/1986 | Japan | 164/483 |
| 63-36954 | 2/1988 | Japan . | |
| 63-90548 | 6/1988 | Japan . | |
| 63-177944 | 7/1988 | Japan . | |
| 0070359 | 3/1990 | Japan | 164/428 |
| 3-230848 | 10/1991 | Japan . | |

OTHER PUBLICATIONS

Patent Abstracts of Japan, vol. 16, No. 7, (M-1198) Jan. 1992.

Patent Abstracts of Japan, vol. 13, No. 310 (M-850)(3658) Jul. 14, 1989.

Patent Abstracts of Japan, vol. 13, No. 289, (M-845)(3637) Jul. 5, 1989.

Patent Abstracts of Japan, vol. 12, No. 251 (M-718) (3098) Jul. 15, 1988.

Patent Abstracts of Japan, vol. 12, No. 445 (M-767) (3292) Nov. 22, 1988.

Patent Abstracts of Japan, vol. 9, No. 87 (M-372) (1810) Apr. 17, 1985.

*Primary Examiner*—Richard K. Seidel

*Assistant Examiner*—James Miner

*Attorney, Agent, or Firm*—Kenyon & Kenyon

[57] ABSTRACT

A method of continuously casting a thin strip by pressing a pair of side walls to both side surfaces of a pair of rotating cooling drums to form a metal bath and rotating said cooling drums so as to cool a molten metal inside the metal bath and to continuously cast the thin strip, comprising the steps of pressing the side walls, which are pre-heated before the start of casting of the thin strip, to the end surface of the rotating cooling drums at a predetermined surface pressure so as to apply deformation corresponding to the shape of the end surfaces of the cooling drums to the side walls, casting under lowered press surface pressure conditions to form a necessary sliding surface required for stable casting, moving the side walls to the positions at which a wear quantity of the sliding surfaces of the side walls reach a target value, and continue casting while maintaining said positions.

3 Claims, 4 Drawing Sheets

CONTINUOUS CASTING METHOD OF THIN STRIP

BACKGROUND OF THE INVENTION

1. Field of the Invention

This invention relates to a method of continuous casting a thin strip from a molten metal by a pair of cooling drums.

2. Description of the Related Art

A twin drum system (which uses a pair of cooling drums) is known as a method of continuous casting a thin strip having a shape approximate to a final shape in the art of continuous casting of metals. The outline of this system will be explained with reference to FIG. 1 of the accompanying drawings. A molten metal M is supplied from a tundish into a metal bath 4 defined by a pair of cooling drums 1, 1 and side walls or dams 3W, 3D, is then cooled by the cooling drums 1, 1 to form a solidified shell on the peripheral surface of each cooling drum 1 or 1. The solidified shells are pressed together and integrated at roll gap portions of the cooling drums 1, 1, and are delivered in the form of a thin strip S.

In the system described above, the side walls are necessary to hold the molten metal between the cooling drums, and have a structure such as the one described in Unexamined Utility Model Publication (Kokai) No. 63-90548, for example. As means for preventing the occurrence of leak of molten through gap between the side wall and the cooling drum end surface, there are known various methods such a the method that press the side wall onto the cooling drum end surfaces at a predetermined pressure or maintains a gap between them during casting, the method that moves the side walls in such a manner as to follow up the wear rate of the side walls (Unexamined Patent Publication (Kokai) No. 3-230848), the method that detects an open quantity of the side walls and regulates the press force (Unexamined Patent Publication (Kokai) No. 63-36954), the method that detects the opening force of the side walls and regulates the press force (Unexamined Patent Publication (Kokai) No. 53-177944), and so forth.

In accordance with the control system described above, which controls the press force to a constant level, however, it is very difficult to continue stable casting for long time. For, even when the press force is kept constant, both of the cooling drums and the side walls undergo non-uniform deformation due to the heat from pre-heating before casting and due to the heat from the molten metal during casting, and it is therefore difficult to get the conformable sliding surfaces of the cooling drum and side wall with each other at an early stage.

In other words, since the shape of the end surface of the cooling drum undergoes deformation due to the heat from the molten metal, the shape during casting is different from the shape before the casting. Accordingly, even if the sliding surface is made uniform in advance by pressing the side walls to the end surface of the cooling drums and rotating the cooling drums prior to the casting start, the resulting effect is not much better.

The side wall receives a reaction force from the cooling drum, such as a sliding friction, squeezing force of the mashy shell under the drum force of the cooling drum, and so forth. This reaction force is unstable. If this reaction force becomes greater than the press force of side wall during the press force constant control, the side walls are pressed back, so that it becomes difficult to keep the sliding motion uniform between the cooling drums and the side walls. In a case of press device using air cylinders, the retreat distance of the side wall when it is pressed back is so great that a gap is defined between the cooling drum end surfaces and the side walls, and causes leak.

On the other hand, it is not economical to maintain a large press force during the casting process because the wearing of the cooling drums and the side walls becomes considerably great. If a large friction groove or grooves occur on the side walls the edges of such grooves are easily to break and result in various casting problems such as entrapment of the broken pieces in the strip, a defective shape at the end portion of the strip due to the contact of the broken edge of the grooves with the solidified shell, and so forth.

Similarly, in accordance with the control system that keeps the gap constant, it is extremely difficult to keep the same throughout the full area of the sliding surface between the drum and the side wall during the casting period because non-uniform thermal deformation occurs in both the cooling drum and the side wall during the casting preparation period and at the initial stage of casting.

On the other hand, the method that moves the side walls in such a manner as to follow up the wear quantity of the side walls is easily to promote non-uniform wear and is not very practical. The method that detects the opening distance or the opening force of the side walls and regulates the press force is not suitable for practical casting operations because the separate measurement of the opening force and the press force is extremely difficult at the present stage and hence, it is extremely difficult to apply the press force in accordance with the detection quantity.

SUMMARY OF THE INVENTION

It is therefore an object of the present invention to eliminate the problems occurring between the side walls and the cooling drum end surface during the casting period.

It is another object of the present invention to reduce the wear quantity of the side walls and to stably carry out the casting operation for long time.

To accomplish the objects described above, the continuous casting method in accordance with the present invention involves the steps of pressing the side walls to the cooling drum end surfaces with a great surface pressure in order to bring, in advance, the shapes of the contact surfaces into conformity (deformation application period); pressing the side walls to the cooling drum end surfaces by a surface pressure that is smaller than the surface pressure described above but is greater than the surface pressure during the steady casting period, immediately before the start of casting, and thereafter starting the casting process (starting the pouring operation of a molten metal between the drums); rotating the cooling drums and advancing the side walls towards the cooling drum end surfaces so as to positively promote wearing and to bring their contact surfaces into mutual conformity (wear promotion period); and after their slide surfaces are allowed to sufficiently adapt to one another in this manner, setting the advancing speed of the side walls to a smaller value so as to reduce and minimize the wear quantity of the side walls, and carry out casting while maintaining the sliding state of both the drums and the side walls (wear restriction period).

In order to judge the switch timing from the wear promotion state of the side walls at the initial stage of casting to the subsequent wear restriction state, it is possible to adopt, besides the casting length as one of the factors, the time elapsed from the start of casting (or from the start of rotation of the drums), the number of times of vibration of the side walls, the change of the side wall press force, the rotation driving torque of the casting drum, the rotating driving power, the leak state from the side walls, the fin adhesion state to the end portions of the cooling drums, and so forth. The switch timing can be determined by either one, or combining at least two of these factors.

Another characterizing feature of the present invention resides in that a target wear quantity is obtained by always advancing the side walls. In other words, the advancing distance of the side walls is measured by detecting their positions by side wall position sensors, the side walls are stopped and are kept at a that position until the target advancing distance (target wear quantity) is attained, when an excessive advancing distance is detected by the sensors. When the insufficient advancing distance state continues, on the other hand, the side walls are advanced until the target advancing distance is obtained.

The excessive advancing state can also be detected by measuring the reaction force acting on the press devices. In other words, the side walls are kept advanced unless any excessive reaction force acts on the press device. When the excessive reaction force acts, the advance of the side walls is stopped, and after the reaction force reduces below a predetermined value, due to the wear of the side walls, the advance of the side walls is started once again.

When the movement of the side walls is controlled in the manner described above, the retreating operation of the press devices does not exist. Accordingly, the abrupt change of the press force resulting from the back lash of the press devices that is likely to occur with the reacting operation of the press devices, does not occur. For this reason, the position control of the side walls can be carried out reliably and easily.

Incidentally, the wear quantity of the side walls changes in accordance with the physical properties of the side walls such as material and hardness, a temperature, the deformation quantity of the cooling drum end surfaces, the surface roughness, the surface pressure between them, and so forth. Therefore, the target wear quantity is determined in consideration of the factors described above.

DESCRIPTION OF THE PREFERRED EMBODIMENTS

Figure 1:
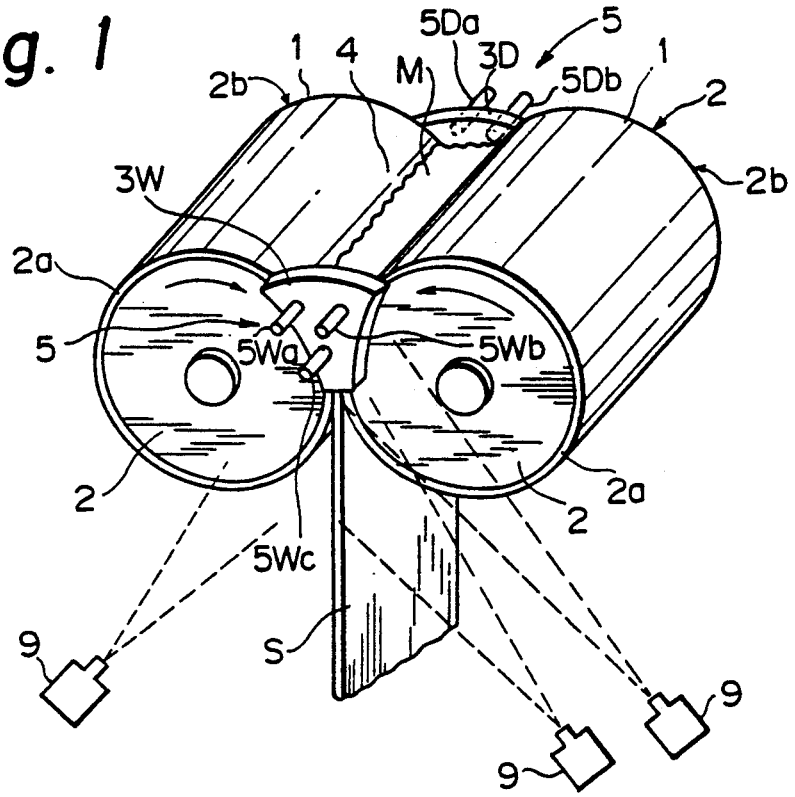
FIG. 1 is a perspective view showing an apparatus of the present invention as a whole.
Figure 2:
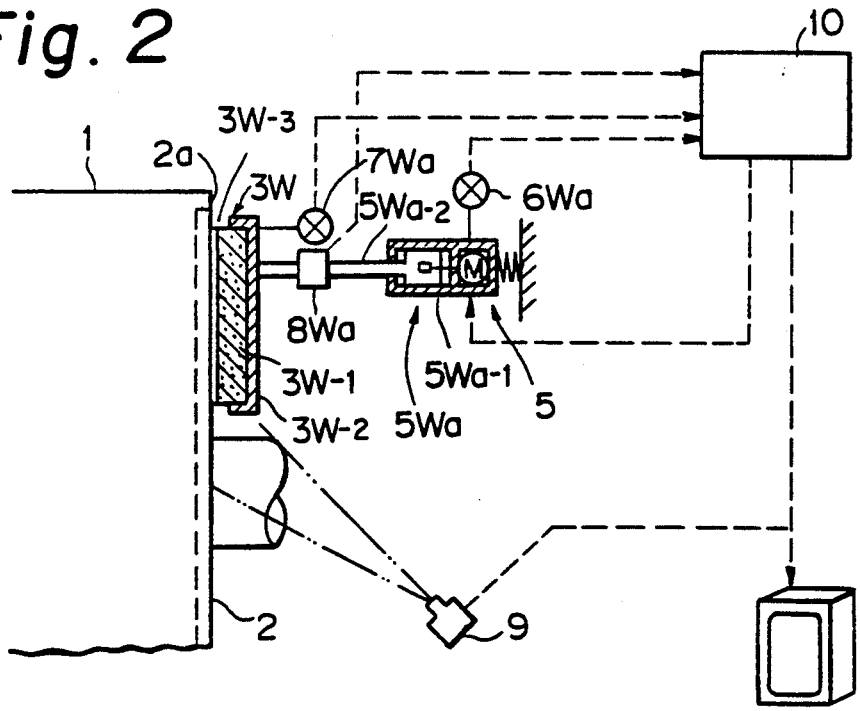
FIG. 2 is a partial sectional, schematic side view of a press device 5*wa* shown in FIG. 1.

To begin with, the apparatus used in the present invention will be explained with reference to FIGS. 1 and 2. As already described, the present invention relates to the casting apparatus of the twin drum system for producing the thin strip cast S as shown in FIG. 1. Referring to FIG. 2, the side walls 3W and 3D are composed of a refractory (base plate) 3W-1 and a metal frame 3W-2, and a ceramic member 3W-3 that comes into contact with the sliding surface 2*a* of the drum end surface 2 and is buried into this refractory member 3W-1. This ceramic member 3W-3 is made of BN, AlN, $Si_3N_4$, etc., as its principal components and in this embodiment, a material containing 50% of BN having a great influence on wear characteristics is particularly preferable.

A plurality of press devices 5 are disposed on the side walls 3W, 3D in order to press them onto the end surface of the cooling drums 2*a*, 2*b*. The press device 5Wa shown in FIG. 2 uses an electro-hydraulic cylinder 5Wa-1 capable of moving back and forth and stopping against the external force.

The said press device 5Wa is disposed on the side wall on the cooling drum work side and on the fixed position side.

The control system in the present invention is constituted in the following way. Namely, the system includes a sensor 6Wa for detecting the moving distance of the press device 5Wa in a longitudinal direction, which is fitted to a cylinder 5Wa-1 of the press device, a sensor 7Wa for detecting the position of the side wall, which is fitted to the metal frame 3W-1 of the side wall, and a press force sensor 8Wa for detecting the side wall press force (reaction force) to the cooling drum end surface, which is fitted to a rod 5W-2 of the press device. Furthermore, the system includes monitor devices 9 for monitoring the fin of the strip, the leak from the side walls, the fin adhering to the cooling drum end portion, and so forth, the devices 9 of which are disposed at suitable positions. These sensors and monitor devices are interconnected to a controller 10 so that the controller 10 processes the data from them.

Figure 3:
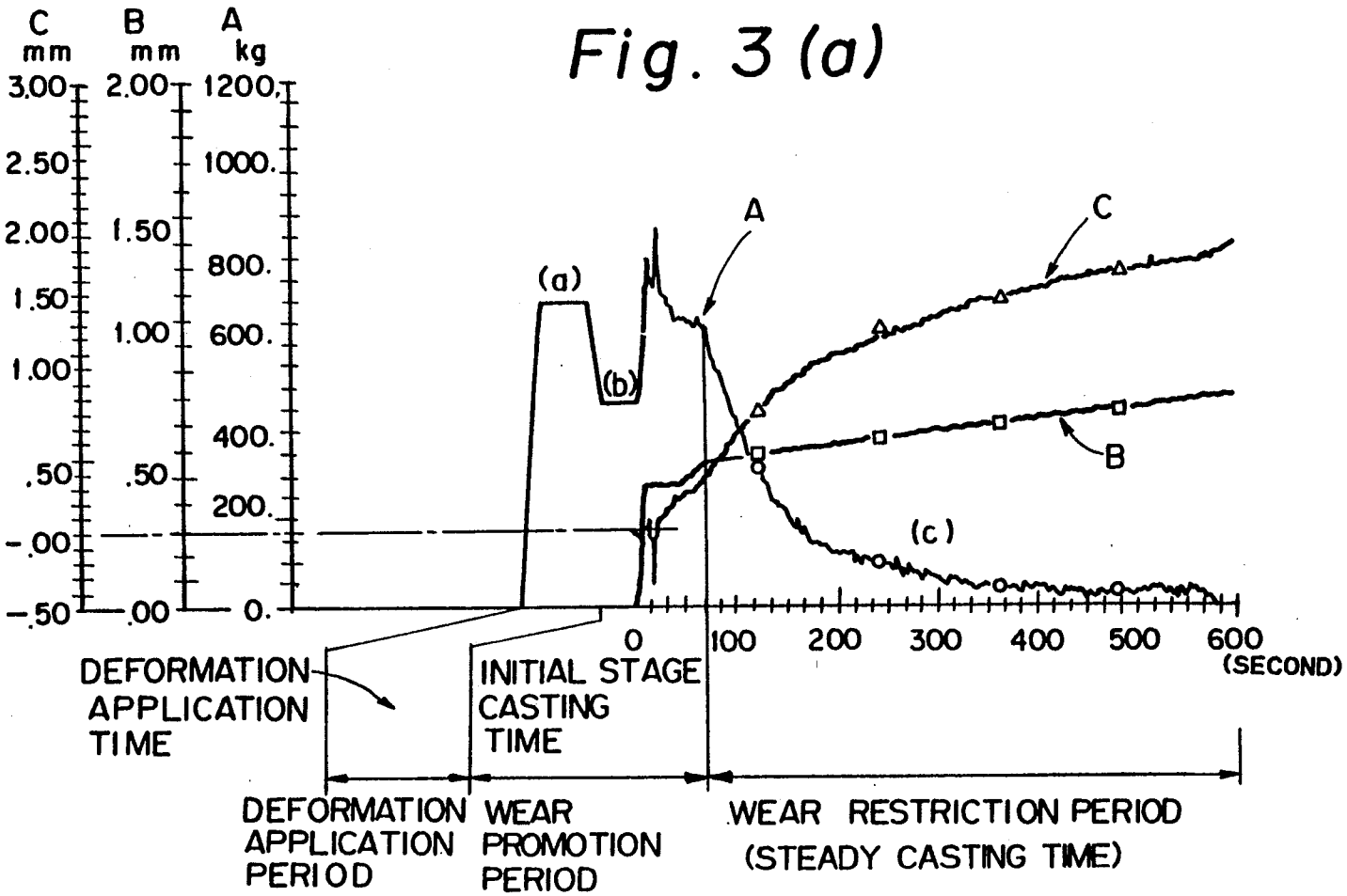
FIG. 3 is a diagram showing the relation between the reaction force of a side wall, an advance distance of the press device, a practical moving distance (wear quantity) of the wall and a work time, wherein FIG. 3(*a*) shows the case of the press device (5Dc) at a lower part of the side wall on a rotation drive side of a cooling drum, and FIG. 3(*b*) shows the case of the press device (5Wc) at the lower part of the side wall on the work side.
Figure 3B:
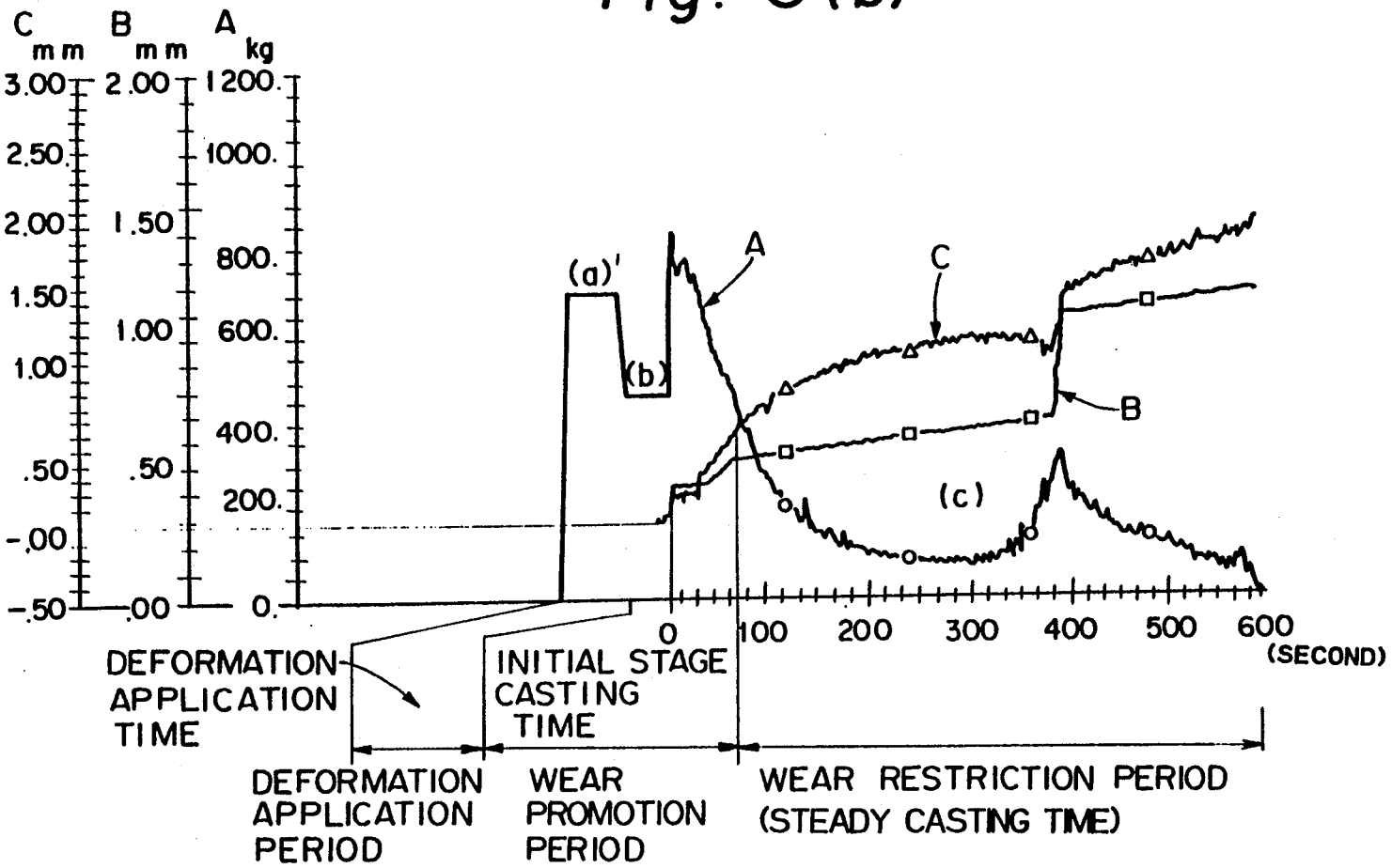

Next, the method of casting and obtaining the thin strip cast by the use of the apparatus described above will be definitely explained with reference to FIGS. 2 and 3(*a*). FIG. 3(*a*) shows the relation between the work time of the side wall 3D and the press device 5Dc (not shown in the drawing) at the lower part of the side wall, the force of reaction (A) of the side wall, the advance distance (B) of the press device and the actual moving distance (C) of the wall.

First of all, the side walls 3W and 3D are pre-heated to 1,200° to 1,400° C. before the start of casting and are then pressed to the slide surfaces 2-*a*, 2-*b* of the cooling drum end surface 2 for about 0.5 to 1 minute through the press devices 5Da, 5Db, 5Dc and 5Wa, 5Wb, 5Wc at the side wall reaction force of 2,400 to 1,200 kg (the reaction force acting on the lower press devices being 1,400 to 700 kg) (the surface pressure ranging from about 20 to about 10 kg/cm$^2$), so that the gap between side walls 3W, 3D and the slide surfaces 2-*a*, 2-*b* is reduced less than 0.1 mm (this deformation application time being represented by the curve A(a) in the diagram). After this time has passed, the side reaction force is lowered to 810 to 580 kg (the surface pressure of 7 to 5 kg/cm$^2$) as represented by the curve A(*b*) in FIG. 3(*a*), and casting is then started at this surface pressure in order to cast a thin strip which is from about 15 to about 30 m long (the wear promotion period).

The advancing speed of the side wall at this time is relatively great and an average wear rate per unit sliding length is from 0.01 to 0.02 mm/m. The wear quantity of the side wall is from 0.15 to 0.6 mm. The sliding portion of the side wall adapts itself well to the heat deformation at the cooling drum end portion and results in an excellent sealing state devoid of leak. For this reason, the advancing distance of the side wall during this period is set to the range of 0.2 to 0.6 mm.

The control described above is made by the press force sensor 8 disposed on each of the press devices by detecting the press force and comparing it with a target value.

Next, the casting process shifts to the wear restriction period of steady casting, and this period will be explained in the case of the press device 5Dc, with reference to FIG. 3(*a*).

When the casting length in the wear promotion period represented by the curve A(b) shown in the diagram reaches the before-mentioned predetermined length, the position of the side wall press device at this time is used as the reference position (zero second). Then, the press device is moved from this position to the cooling drum end surface in accordance with the curve B, and after the target quantity is casted, such as after about 600 second as in this embodiment, the moving distance corresponding to this time is obtained. The practical moving distance of the wall at this time increases in proportion to the moving distance of the press device in accordance with the curve C. Accordingly, it can be understood that the side wall is worn out in harmony with the movement of the press device.

The casting condition is switched to the steady casting condition at the point of movement described above. The advancing speed of the side wall press device is controlled so as to reach the target speed or in other words, to reach a desired mean wear rate (e.g., 0.0033 mm/sec), and the thin strip is cast and produced in a desired length (e.g., 500 m) while maintaining said advancing speed.

The reaction force of the side wall drastically increases immediately after the start of the movement of the press device due to the rotational friction of the cooling drum as represented by the curve A(c) in the diagram but drops thereafter. When the point of movement described above is passed, the reaction force continues to lessen with a smooth curve, and thus represents the fact that normal casting is being carried out.

The side wall reaction force at the reference position of the press device, the time from this reference position to the switch timing of the steady casting condition and the wear rate are stipulated in accordance with the casting conditions, respectively.

Non-uniform wear of the side walls can be prevented by synchronizing the advancing speeds of the side wall press devices 5Wa, 5Wb, 5Wc (or 5Da, 5Db, 5Dc) with their advancing operations such as advance timing and stop timing during the casting operation. Synchronization of the advancing operations of the side walls is effected by interconnecting the controllers 10 of all the press devices (three, in this embodiment) of each side wall. In other words, all the side wall press devices are simultaneously advanced at the same advancing speed, and the subsequent change quantity and change timing as well as cessation of the advancing operations are carried out in synchronism with one another. In this case, it is not particularly necessary to synchronize the operations of the side walls on the drive side and on the work side.

The advancing operations of the side walls for applying deformation to the side walls before the start of the casting process need not be synchronized, and are controlled by the press force control.

EXAMPLE 1

The side walls 3D, 3W were pre-heated to 1,330° C. before the start of the casting process and were pressed to the end surface of a cooling drum with a side wall reaction force of 1,200 kg (the reaction force of the press device at the lower part of the side wall being 700 kg) and with a surface pressure of about 10 kg/cm$^2$, for about one minute. In this way, the surfaces of the side wall is deformed to reduce the gap between side wall and the sliding surfaces of the cooling drum end surface 2*a* and 2*b* to be less than 0.1 mm.

Next, the side wall reaction force was lowered to 810 kg (the reaction force of the press device at the lower part of the side wall being 475 kg) with a surface pressure of 7.3 kg/cm$^2$, and the casting of a strip having a thickness of 3 mm was started and continued up to 30 meters of casting length. The mean wear rate of the side walls at this time was about 0.013 mm/m and their wear quantity was about 0.4 mm.

Steady casting was then carried out while controlling the positions of the side walls by using the moving distance sensors 6 for the press device 5 and the side wall position sensors 7.

The casting process described above will be explained in the case of the press device 5Dc.

The side walls were advanced by a distance of 0.4 mm within 100 seconds from the position of the press device (or in other words, the position of the rod) when the before-mentioned wear promotion period was completed, with this position as the reference position. While the advancing speed of the press device was regulated in such a manner as to set the wear rate to 0.0005 mm/sec, steady casting of a length of 500 m was carried out. The wear quantity of the side walls during this casting process was about 1.0 mm, thereby indicating that the wear quantity can be drastically reduced in comparison with the wear quantity (about 5 mm) of the conventional casting method.

The side walls used in this embodiment were made of a material of an $Si_3N_4$ composite system containing 45% of BN and stiffness (spring constant) of the push devices as a whole was 500 kg/mm.

EXAMPLE 2

An explanation will be given in the case of the push device 5Wc for the side wall on the opposite side to that of Example 1 in the same cast as that of Example 1, with reference to FIG. 3(*b*).

After the casting operation continued in a way similar to that in FIG. 3(*a*), the surface pressure started to increase after 300 seconds as represented by the curve A(c), the side walls moved back at about 340 seconds and leak occurred. Therefore, the stroke of the press device was quickly extended at 380 seconds and were moved by a distance of about 0.4 mm. As a result, the side walls were compulsively moved forth and the wear quantity of the side walls increased. Leak was thus stopped and the casting operation could be thereafter carried out normally.

The side walls presumably moved back as described above because foreign matter, such as a skull deposited on the side walls, entered between the side walls and the cooling drum end surface and this gap was compulsively separated.

COMPARATIVE EXAMPLE 1

Figure 4:
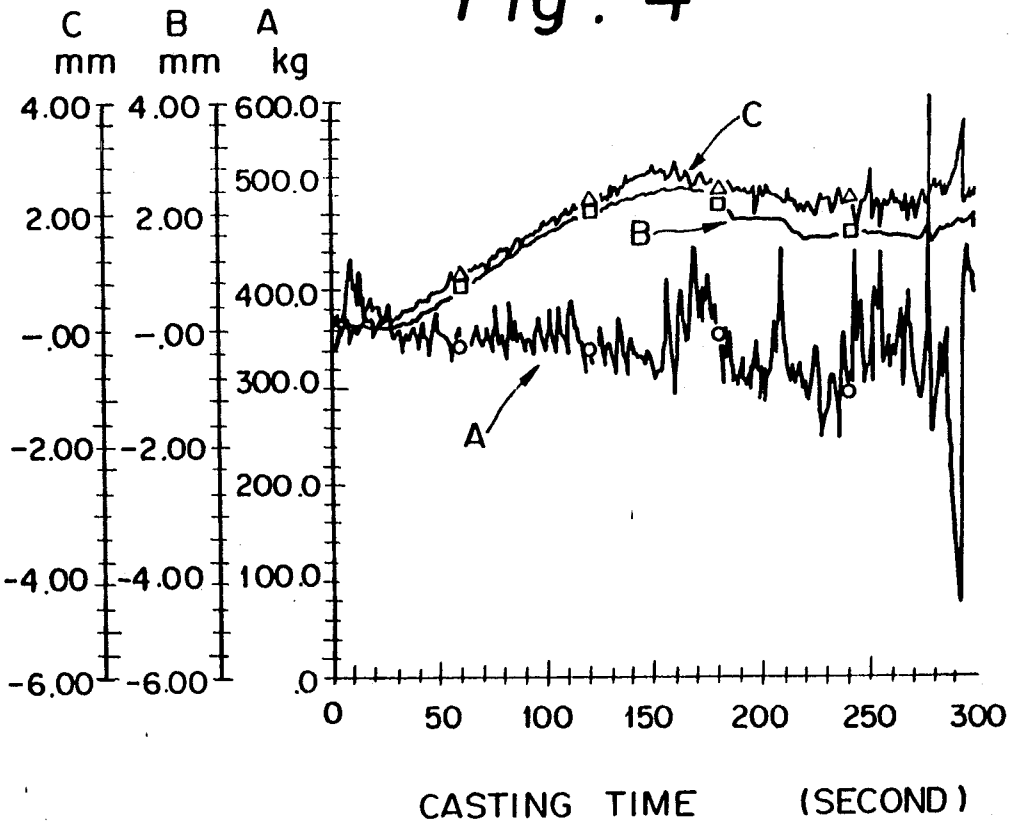
FIG. 4 is a diagram showing a relation similar to the one shown in FIG. 3(*b*) in a comparative example.

In the casting apparatus shown in FIG. 2, the side walls which were pre-heated to 1,330° C. before the start of the casting operation were pressed to the cooling drum end surface at the press force of 1,200 kg. Thereafter, the casting operation was started at a predetermined side wall reaction force of 360 kg as shown in FIG. 4.

The reaction force dropped after 150 seconds from the start as shown by the curve A, the press devices as shown by the curve B moved back and fins occurred. The reaction force increased at about 170 seconds, and the casting operation was restored to a relatively stable operation. However, the press devices moved back once again at about 200 seconds and leak occurred. Thereafter, the casting operation could not be restored to the normal operation and was therefore stopped at 300 seconds.

The first retreat of the press devices was presumably generated by the skull deposited on the side walls.

It could thus be confirmed that the method of the present invention is extremely suitable for large capacity casting. In other words, it was confirmed that the method of the invention can quickly bring the casting operation to a steady casting condition after the start of casting and can minimize the wear quantity of all the side walls throughout the full casting period while maintaining an excellent side seal thereof.

We claim:

1. A method of continuously casting a thin strip by pressing a pair of side walls onto both side surfaces of a pair of rotating cooling drums to form a metal bath and rotating said cooling drums so as to cool a molten metal inside said metal bath and to cast the thin strip, comprising the steps of:

pressing said side walls pre-heated before the start of casting to said end surfaces of said cooling drums at a predetermined surface pressure between 3 to 30 $kg/cm^2$ and applying deformation to said side walls corresponding to the shape of said end surfaces of said cooling drums;

lowering said press surface pressure, starting the casting, advancing said side walls toward said end surfaces of said cooling drums to generate a predetermined friction on said side walls, and thus forming slide surfaces necessary for stable casting; and lowering the advancing speed of said side walls after said necessary slide surfaces are formed, and continuing stable casting.

2. A continuous casting method of a thin strip according to claim 1, wherein said advancing speed during said stable casting is within the range of 0.00005 to 0.0015 mm/sec.

3. A continuous casting method of a thin strip according to claim 1, further comprising providing a plurality of press devices for pressing each side wall, wherein all of the press devices on each side of said pair of side walls are operated in synchronism with one another.

* * * * *